US010463184B2

(12) United States Patent
Taylor

(10) Patent No.: US 10,463,184 B2
(45) Date of Patent: Nov. 5, 2019

(54) STORABLE SHOE HORN AND SOCK REMOVING TOOL

(71) Applicant: Easy To Use Products, Farr West, UT (US)

(72) Inventor: Kevin Darrell Taylor, Farr West, UT (US)

(73) Assignee: EASY TO USE PRODUCTS, Farr West, UT (US)

( * ) Notice: Subject to any disclaimer, the term of this patent is extended or adjusted under 35 U.S.C. 154(b) by 94 days.

(21) Appl. No.: 15/907,589

(22) Filed: Feb. 28, 2018

(65) Prior Publication Data

US 2019/0261800 A1 Aug. 29, 2019

(51) Int. Cl.
*A47G 25/90* (2006.01)
*A47G 25/82* (2006.01)

(52) U.S. Cl.
CPC ..... *A47G 25/908* (2013.01); *A47G 25/82* (2013.01); *A47G 25/907* (2013.01)

(58) Field of Classification Search
CPC ..... A47G 25/80; A47G 25/90; A47G 25/901; A47G 25/908
USPC ..... D2/641, 642
See application file for complete search history.

(56) References Cited

U.S. PATENT DOCUMENTS 2,939,618 A * 6/1960 Mangels ..... A47G 25/80 223/113
3,473,177 A * 10/1969 Palson ..... A43D 3/1466 12/115.6
4,355,745 A * 10/1982 Nelson ..... A47G 25/82 223/118
4,793,646 A * 12/1988 Michaud, Jr. ..... B63B 21/54 114/221 R
5,626,269 A * 5/1997 Duarte ..... A47G 25/905 223/112
6,763,982 B1 7/2004 Livornese
6,942,129 B2 * 9/2005 Ferraioli ..... A47G 25/905 223/113
7,337,933 B1 * 3/2008 Klinberg ..... A47G 25/82 223/118
8,215,524 B1 * 7/2012 Swisher ..... A47G 25/82 223/111
8,919,620 B2 * 12/2014 Taylor ..... A47G 25/905 223/111
2015/0083761 A1 * 3/2015 Clifton ..... A47G 25/82 223/118

* cited by examiner

*Primary Examiner* — Ismael Izaguirre
(74) *Attorney, Agent, or Firm* — Roberts Mlotkowski Safran Cole & Calderon P.C.; Jorie L. Stroup

(57) ABSTRACT

A shoe horn and sock removing tool is disclosed. In embodiments, the shoe horn and sock removing tool comprises a handle portion and a shoe horn and sock removing portion. The shoe horn and sock removing portion comprises a main body and a head. The head comprises a first end including a gripping portion and a second end including a curved heel-engaging portion. The head is pivotally connected to the main body and is configured to be pivoted between a locked shoe horn position wherein the gripping portion extends past an end of the main body, and a locked sock removing position wherein the curved heel-engaging portion extends past the end of the main body.

14 Claims, 7 Drawing Sheets

STORABLE SHOE HORN AND SOCK REMOVING TOOL

BACKGROUND

The present invention relates generally to medical aid devices and, more particularly, to shoe horns and sock removal devices.

SUMMARY

In an aspect of the invention, a shoe horn and sock removing tool includes: a handle portion; and a shoe horn and sock removing portion comprising: a main body; and a head comprising a first end including a gripping portion and a second end including a curved heel-engaging portion, wherein the head is pivotally connected to the main body and is configured to be pivoted between a locked shoe horn position wherein the gripping portion extends past an end of the main body, and a locked sock removing position wherein the curved heel-engaging portion extends past the end of the main body.

In another aspect of the invention, a shoe horn and sock removing tool includes: a main body; and a head comprising a first end including a gripping portion comprised of a high friction material and a second end including a curved heel-engaging portion, wherein the head is pivotally connected to the main body and is configured to be pivoted between a locked shoe horn position wherein the curved heel-engaging portion is directly adjacent the main body and the gripping portion extends past an end of the main body, and a locked sock removing position wherein the gripping portion is directly adjacent the main body and the curved heel-engaging portion extends past the end of the main body; a handle portion; and a means for removably connecting the shoe horn and sock removing portion to the handle portion.

In another aspect of the invention, a method for utilizing a shoe horn and sock removing tool comprises: providing a shoe horn and sock removing tool including a handle portion and a shoe horn and sock removing portion, the shoe horn and sock removing portion including a main body pivotally connected to a head about a connector; pivoting the head about the connector from a shoe horn position, wherein a gripping portion of the head extends past an end of the main body, to a sock removing position, wherein a curved heel-engaging portion of the head extends past the end of the main body.

BRIEF DESCRIPTION OF THE DRAWINGS

The present invention is described in the detailed description which follows, in reference to the noted plurality of drawings by way of non-limiting examples of exemplary embodiments of the present invention.

DETAILED DESCRIPTION

The present invention relates generally to medical aid devices and, more particularly, to shoe horns and sock removal devices.

Figure 1:
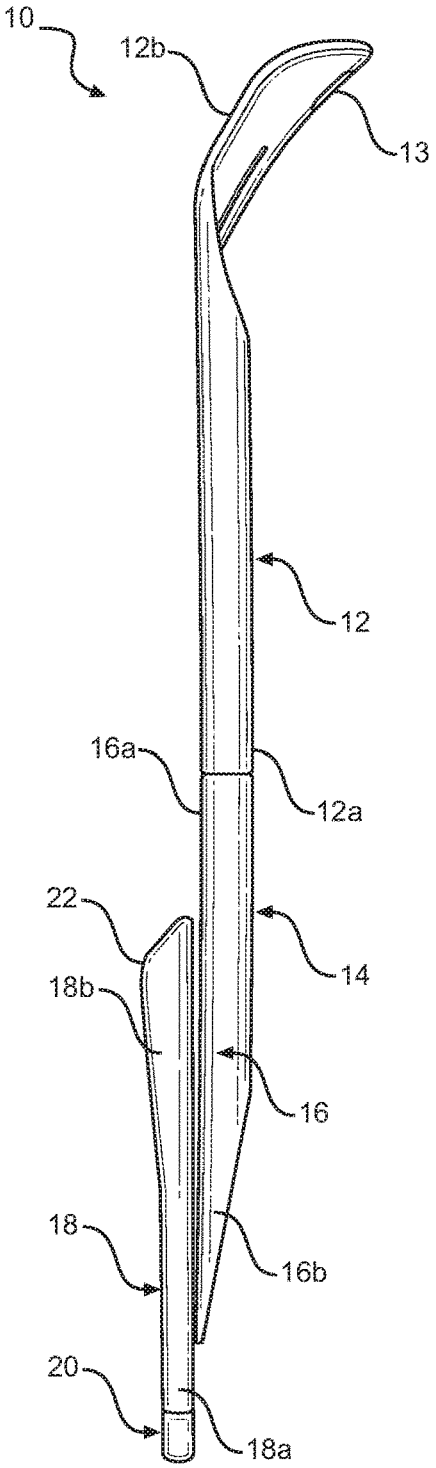
FIG. 1 depicts a side view of a storable shoe horn and sock removing tool of the present invention.

FIG. 1 depicts a side view of a storable shoe horn and sock removing tool 10 (hereafter the tool 10) of the present invention. In embodiments, the tool 10 comprises a handle portion 12 removably connected to a shoe horn and sock removing portion 14 at a first 12*a* of the handle portion 12. In aspects, the handle portion 12 comprises an aperture 13 at a second end 12*b* thereof, for enabling a user to hang the tool 10 on a hook or other fixture for easy storage. In embodiments, the shoe horn and sock removing portion 14 comprises a main body 16 having a first end 16*a* removably connected to the first end 12*a* of the handle portion 12, and a second end 16*b* pivotally connected to a shoe horn and sock removing head 18 (hereafter the head 18). In aspects, a gripping portion 20 is located at a first end 18*a* of the head 18, and a curved heel-engaging portion 22 is located at a second end 18*b* of the head 18. The griping portion 20 may be an integral part of the head 18, or may be removably attached thereto.

The handle portion 12 and shoe horn and sock removing portion 14 may each be comprised of a lightweight material; preferably rigid, injection moldable plastic. In aspects, the head 18 comprises a smooth or low friction material (e.g., plastic), while the gripping portion 20 attached thereto comprises a rubber material or other material having high friction properties (frictional properties higher than those of the shoe horn and sock removing portion 14) to aid in the gripping/retention of sock material during sock removal.

Figure 2:
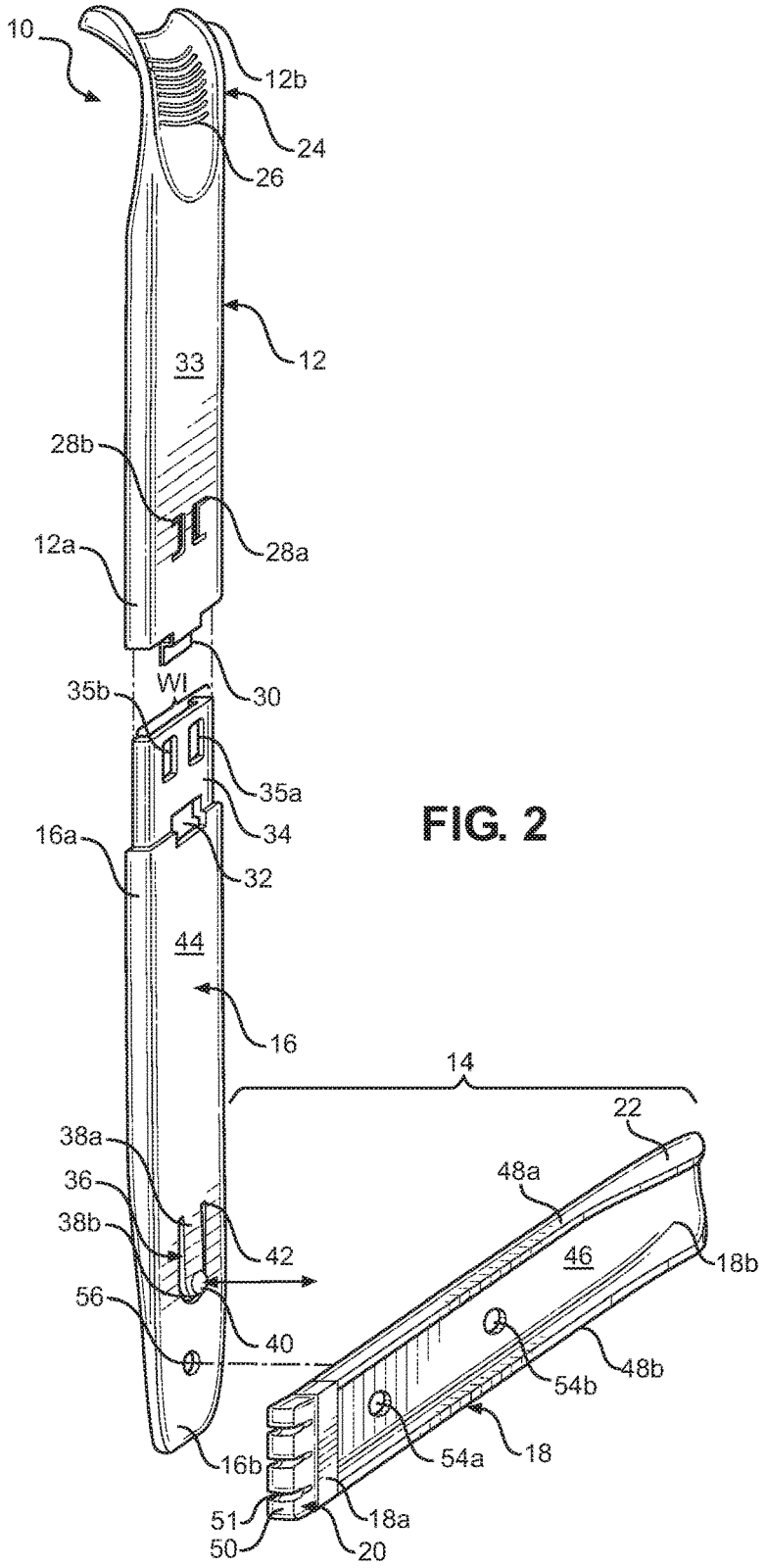
FIG. 2 shows an exploded front perspective view of the tool of FIG. 1.

FIG. 2 shows an exploded front perspective view of the tool 12 of FIG. 1. As depicted in FIG. 2, in embodiments, the handle portion 12 comprises a curved gripping portion 24 located at the second end 12*b* adapted to facilitate the gripping of the handle portion 12 by a user's hand. In aspects, the handle portion 12 further comprises a plurality of upstanding ridges 26 extending from a surface of the handle portion 12 to provide a frictional surface to further facilitate the gripping of the handle portion 12 by the user's hand. In embodiments, the upstanding ridges 26 and handle portions 12 are formed as a unitary structure. In other embodiments, the upstanding ridges 26 are connected to the handle portion 12, such as through over molding or other adhesion process.

Still referring to FIG. 2, apertures 28*a* and 28*b* formed within the handle portion 12 are shown. In embodiments, a means for removably attaching the handle portion 12 to the shoe horn and sock removing portion 14 comprises an engagement finger 30. In aspects, the engagement finger 30 extends from the first end 12*a* of the handle portion 12, and is configured to engage with a retention aperture 32 formed in the first end 16*a* of the main body 16. In aspects, the engagement finger 30 comprises a substantially L-shape tab, wherein a bottom of the tab is located away from a front planar wall 33 of the handle portion 12. In aspects, a distal end portion 34 extends from the main body 16 and has a width W/which is sized to engage with and fit snuggly within a back portion of the handle portion 12, as is discussed in more detail below with respect to FIG. 3A. In embodiments, tab-receiving apertures 35*a* and 35*b* are located between the end of the distal end portion 34 and the retention aperture 32. In aspects, the retention aperture 32 is formed into the main body 16 and the distal end portion 34.

With continued reference to FIG. 2, the main body 16 of the shoe horn and sock removing portion 14 includes a flexible tab 36 comprising a first end 38*a* attached to the main body 16 and a second end 38*b* having an engagement button 40 extending outwardly therefrom. In embodiments, the flexible tab 36 is formed with the main body 16 as a unitary structure, and is separated from the main body 16 about its opposing side walls and second end 38*b* by a channel 42. With this configuration, flexible tab 36 is configured to flex away from a planar face 44 of the main body 16 (e.g., at an oblique angle to the planar face 44). In embodiments, the engagement button 40 has a cylindrical shape, but could be other shapes without departing from the invention.

As depicted in FIG. 2, the head 18 includes a front surface 46 and opposing side walls 48*a* and 48*b* extending therefrom. The front surface 46 is substantially planar at the first end 18*a*, and gradually increases in curvature as it extends into the second end 18*b*. At the second end 18*b*, the front surface 46 is curved to comfortably engage a user's heel. In embodiments, the gripping portion 20 at the first end 18*a* includes a plurality of sock gripping portions indicated at 50 separated by channels indicated at 51. In embodiments, the head 18 includes a connector (shown at 52 in FIG. 3) extending from a back surface thereof between receiving apertures 54*a* and 54*b*, and the connector 52 is configured to be received in an opening 56 formed in the second end 16*b* of the main body 16. In aspects, the receiving apertures 54*a* and 54*b* are each sized to receive therein the engagement button 40 of the flexible tab 36 to selectively lock the head 18 in either a shoe horn position or a sock removing position, respectively. It should be understood that the flexible tab 36 and receiving apertures 54*a* and 54*b* are shown as a preferred embodiment, other means for selectively locking the head 18 to the main body 16 in a shoe horn position or sock removing position may be utilized.

Figure 3A:
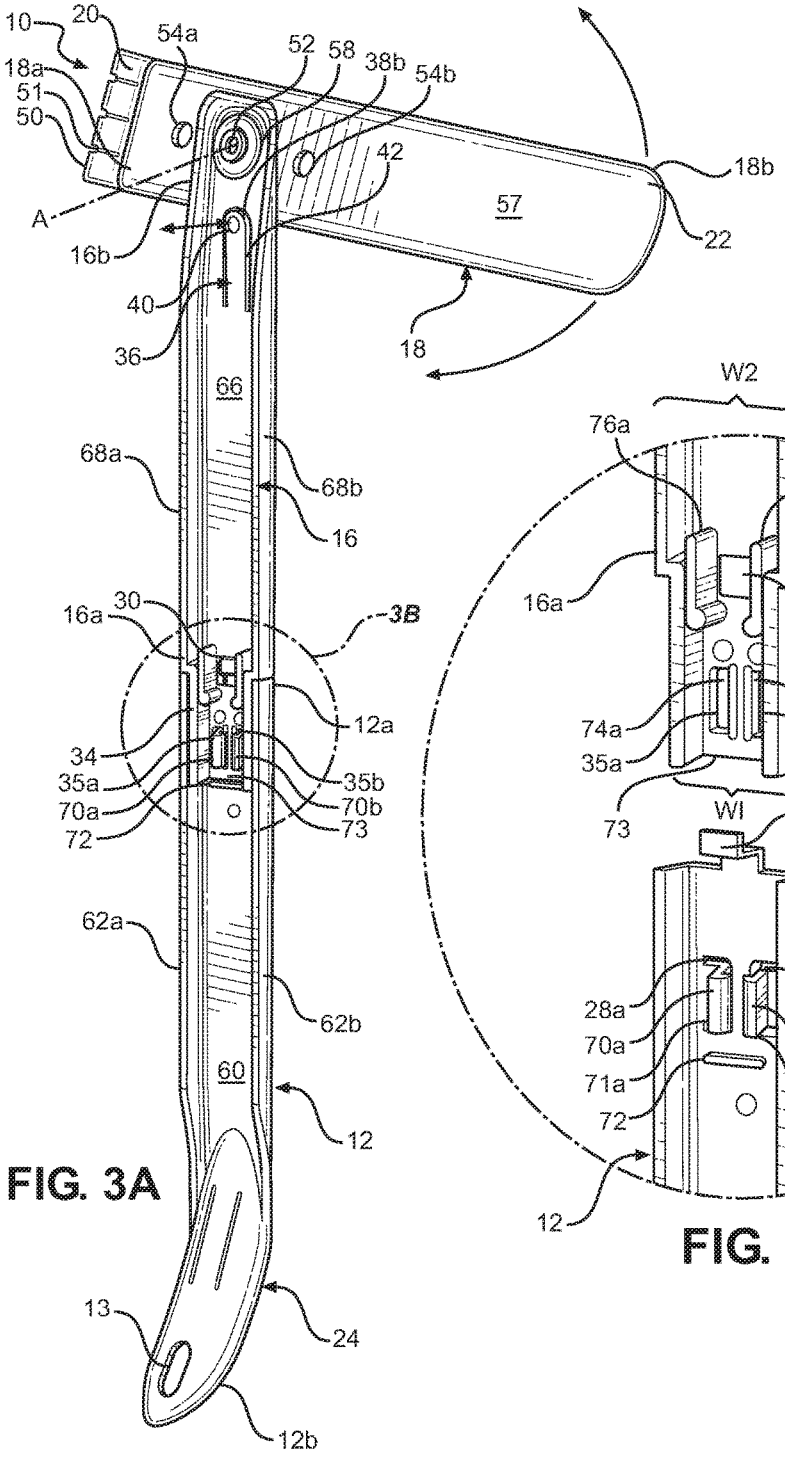
FIG. 3A shows a back perspective view of the tool of FIG. 1.

FIG. 3A depicts a back perspective view of the tool 10 of FIG. 1. In aspects, the head 18 is pivotally mounted to the second end 16*b* of the main body 16. In aspects, the connector 52 extending from a back surface 57 of the head 18 is received within the opening 56 in the second end 16*b* of main body 16. In embodiments, a metal clamping washer 58 or other securing means is utilized to fix the main body 16 to the connector 52 of the head 18 such that the head 18 may be pivoted about an axis A extending through the center of the connector 52.

Figure 3B:
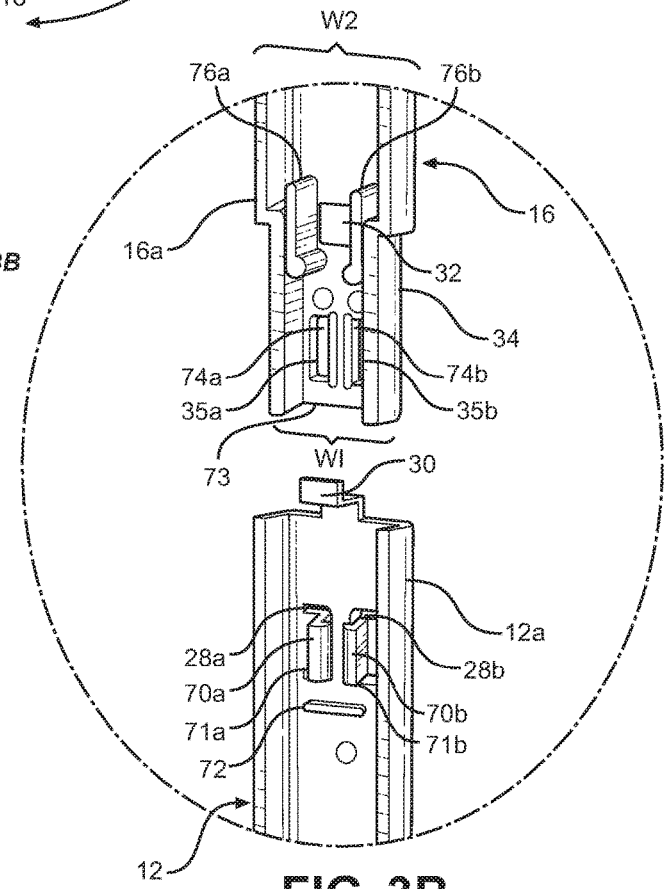
FIG. 3B shows an exploded view of connecting portions of the tool of FIG. 1.

Still referring to FIG. 3A, in embodiments, the handle portion 12 comprises a substantially planar back surface 60 with opposing sidewalls 62*a* and 62*b* extending therefrom. Similarly, in embodiments, the shoe horn and sock removing portion 14 comprises a substantially planar back surface 66 with opposing sidewalls 68*a* and 68*b* extending therefrom. In aspects, the side walls 68*a* and 68*b* taper from a width W2 at the main body 16 to a narrower width W1 at the distal end portion 34 thereof, as best seen in FIG. 3B In aspects, the distal end portion 34 fits snuggly between opposing side walls 62*a* and 62*b* of the handle portion 12 when in a connected configuration shown in FIG. 3A. In this connected position, tabs 70*a* and 70*b* project outwardly from the substantially planar back surface 60 of the handle portion 12 and extend through respective tab-receiving apertures 35*a* and 35*b* of the main body 16. In aspects, a retention flange 72 extends from the substantially planar back surface 60 of the handle portion 12 and is positioned to be adjacent to or in contact with an end wall 73 of the of the distal end portion 34.

FIG. 3B shows an exploded view of connecting portions of the tool of FIG. 1. In aspects, tabs 70*a* and 70*b* are at least somewhat flexible and have retention fingers 71*a*, 71*b* extending therefrom which are adapted to snap over receiving portions 74*a*, 74*b* extending from the back surface of the distal end portion 34 adjacent respective tab-receiving apertures 35*a* and 35*b*. Referencing FIGS. 3A and 3B, it can be understood that a user may removably connect the handle portion 12 to the main body 16 of the shoe horn and sock removing portion 14 using the following method. The term removably connect as used herein refers to the ability to connect and disconnect the handle portion 12 to the main body 16 without breaking or otherwise altering the structure of the invention. Preferably, the main body 16 is removably attached to the handle portion 12 such that a user can easily connect or disconnect the main body 16 and the handle portion 12 without the use of tools.

In aspects, with the handle portion 12 held at an angle with respect to the main body 16, a user inserts engagement finger 30 of the handle portion 12 into the retention aperture 32 of the main body 16 and pivots that handle portion 12 about the tab 30 until the distal end portion 34 is snap-fittingly received between opposing sidewalls 62*a* and 62*b* of handle portion 12. With this configuration, the tabs 70*a* and 70*b* are received within respective tab-receiving apertures 35*a*, 35*b*, and the retention fingers 71*a* and 71*b* are snap-fit over respective receiving portions 72*a* and 72*b* of the distal end portion 34. In embodiments, the main body 16 further comprises opposing stiffening brackets 76*a*, 76*b* extending from the back surface of the distal end portion 34. Such stiffening brackets 76*a*, 76*b* add structural stability about the retention aperture 32 and prevent undesirable flexing of the tool 10 at the interaction of the main body 16 and the distal end portion 34 extending therefrom.

While FIGS. 2, 3A and 3B illustrate structures for a particular means for removably connecting the handle portion 12 to the main body 16, it should be understood that other means for removably connecting the handle portion 12 from the main body 16 may be utilized. In preferred embodiments, the handle portion 12 is connected to the main body 16 by a means for connecting and disconnecting the handle portion 12 and the main body 16 shown in FIGS. 1-3B, wherein a user may easily snap the handle portion 12 onto the main body 16 and un-snap the handle portion 12 from the main body 16 for storage of the tool 10.

Figure 4B:
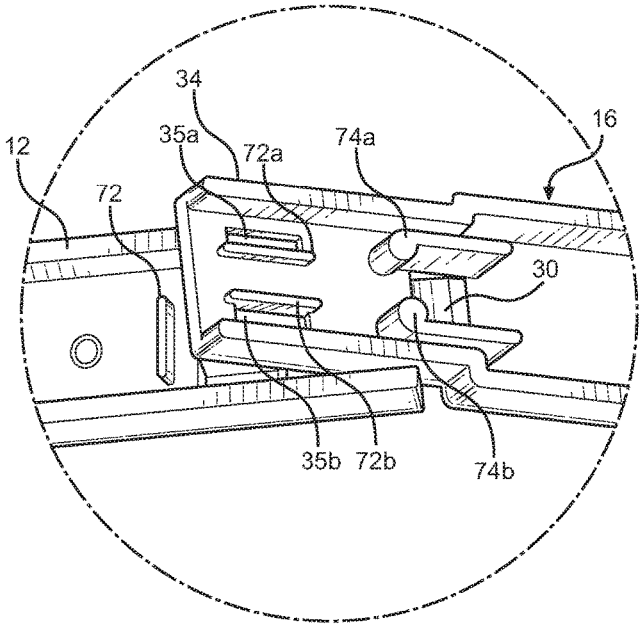
FIGS. 4A and 4B show a first use scenario of the tool of FIG. 1, wherein the tool can be readily broken down for storage purposes.
Figure 4A:
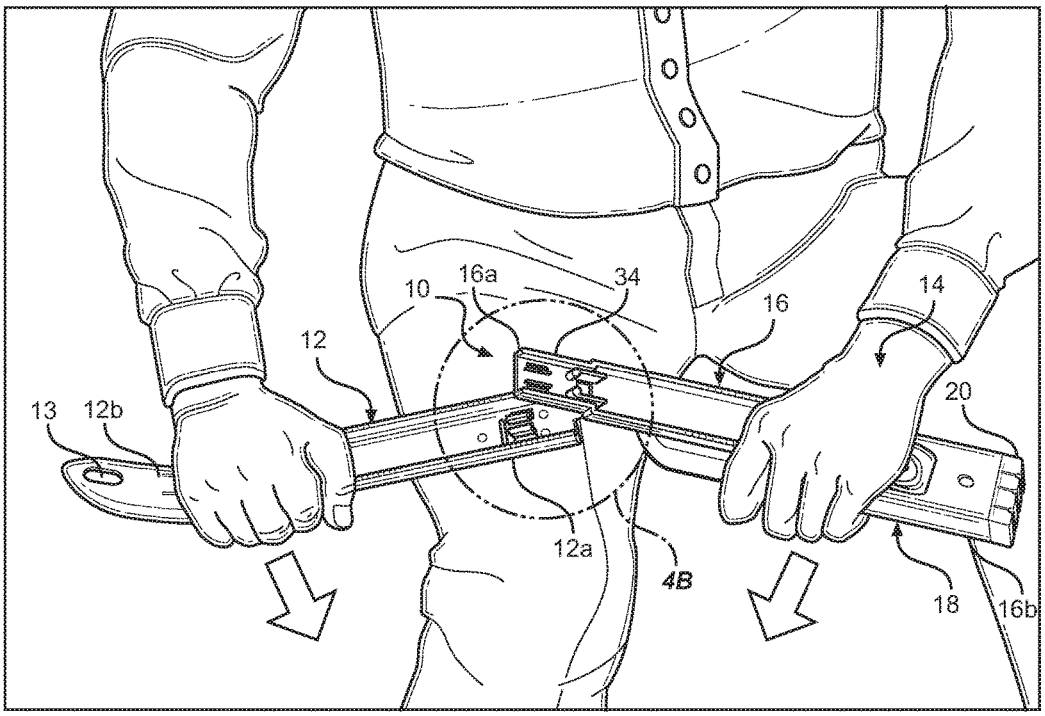

FIGS. 4A and 4B show a first use scenario of the tool 10 of FIG. 1, wherein the tool 10 can be readily broken down for storage purposes. In embodiments, the tool 10 may be rigidly secured together as shown in FIG. 3A, and easily disconnected by a user applying a sharp downward force to the respective handle portion 12 and main body 16 while the respective first ends thereof are braced or held stationary, such as over a user's thigh. In aspects, retention fingers 71*a* and 71*b* are configured such that appropriate force from a user will flex the retention fingers 71*a* and 71*b* such that the retention fingers may be separated from the respective receiving portions 72*a* and 72*b*, and the handle portion 12 disconnected from the main body 16. Thus, embodiments of the invention advantageously provide a sturdy tool 12 which can be broken down for storage with minimal effort of a user.

Figure 5A:
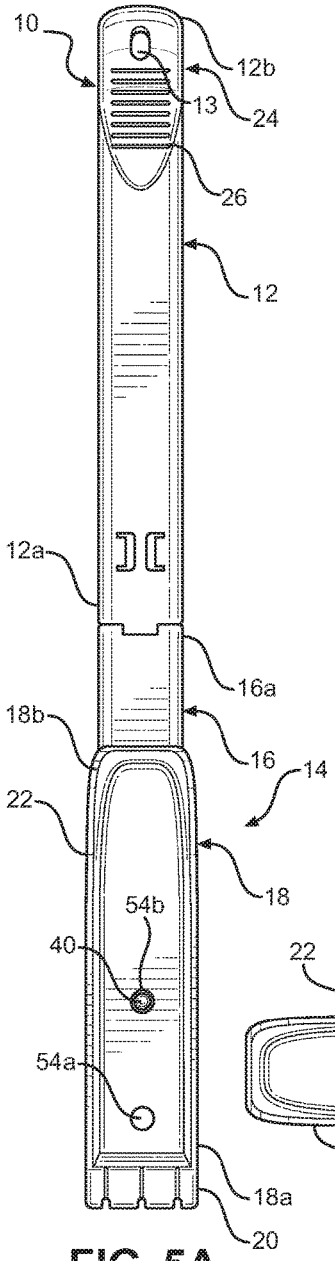
FIG. 5A shows the head of the tool of FIG. 1 in a sock removing position.

FIG. 5A shows the head of the tool 10 of FIG. 1 in a sock removing position. As depicted in FIG. 3A, the head 18 of the tool 10 is pivotally mounted to the main body 16 about the axis A. With this configuration, the head 18 may be pivoted to the sock removing position shown in FIG. 5A, wherein the gripping portion 20 of the head 18 is at one end of the tool 10 and the curved gripping portion 24 is at an opposing end of the tool 10. With this configuration, the engagement button 40 of the flexible tab 36 is received within the receiving aperture 54*b* of the head 18. In aspects, the flexible tab 36 applies a force to bias the engagement button 40 within the receiving aperture 54*b* to lock the head 18 in place with respect to the main body 16.

Figure 5B:
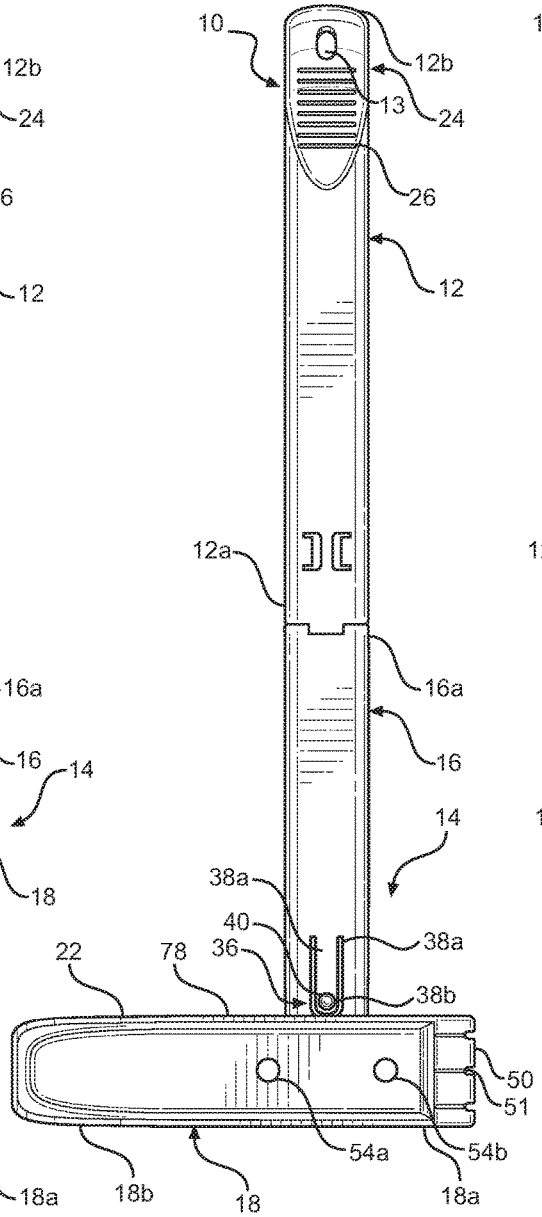
FIG. 5B shows the head of the tool of FIG. 1 in a neutral middle position.

FIG. 5B shows the head of the tool of FIG. 1 in a neutral middle position. In embodiments, the bias force applied by the flexible tab 36 to hold the engagement button 40 within the receiving aperture 54*b* can be overcome by applying a downward force to the engagement button 40, such as through a user applying force to the engagement button 40 with a finger. Applying a downward force to the engagement button 40 causes the flexible tab 36 to pivot about its first end 38*a*, unlocking the flexible tab 36 from the head 18 and enabling a user to pivot the head 18 about the axis A (shown in FIG. 3A) to a neutral middle position, wherein the engagement button 40 is not engaged with the head 18. In embodiments, the engagement button 40 is configured with a rounded surface, and a peripheral outer rim 78 of the head 18 is also configured with a rounded surface, such that the engagement button 40 is biased downward away from the head 18 by the outer wall 78 when force is applied by a user to swing the outer wall 78 from the neutral middle position to either a sock removing position (FIG. 5A) or a shoe horn position (FIG. 5C).

Figure 5C:
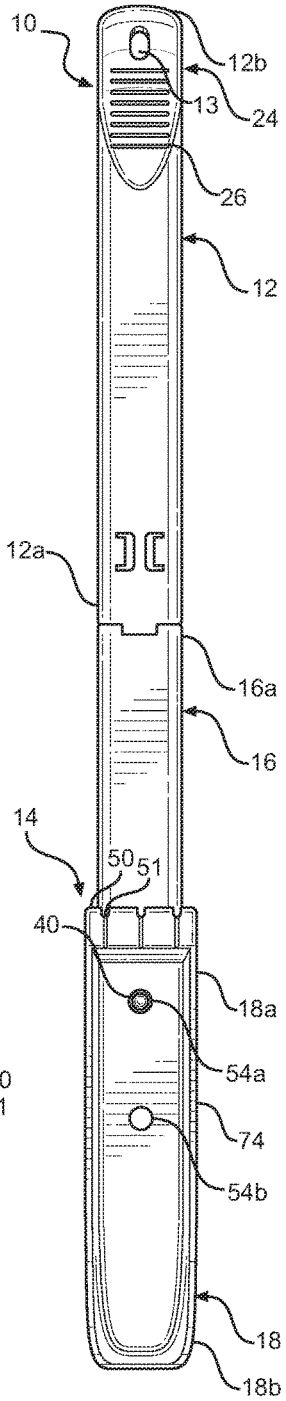
FIG. 5C shows the head of the tool of FIG. 1 in a shoe horn position.

FIG. 5C shows the head of the tool of FIG. 1 in a shoe horn position. It should be understood that the head 18 may be pivoted from the neutral position of FIG. 5B to the sock removing position shown in FIG. 5C, wherein the curved heel-engaging portion 22 is at one end of the tool 10 and the curved gripping portion 24 is at an opposing end of the tool 10. With this configuration, the engagement button 40 of the flexible tab 36 is received within the receiving aperture 54*a* of the head 18. In aspects, the flexible tab 36 applies a force to bias the engagement button 40 within the receiving aperture 54*a* to lock the head 18 in place with respect to the main body 16. As noted above, the bias force applied by the flexible tab 36 to hold the engagement button 40 can be overcome by applying a downward force to the engagement button 40, such as through a user applying force to the engagement button 40 with a finger. Applying a downward force to the engagement button 40 causes the flexible tab 36 to pivot about its first end 38*a*, unlocking the flexible tab 36 from the head 18 and enabling a user to pivot the head 18 about the axis A (shown in FIG. 3A) to the neutral middle position depicted in FIG. 5B, wherein the engagement button 40 is not engaged with the head 18.

Figure 6:
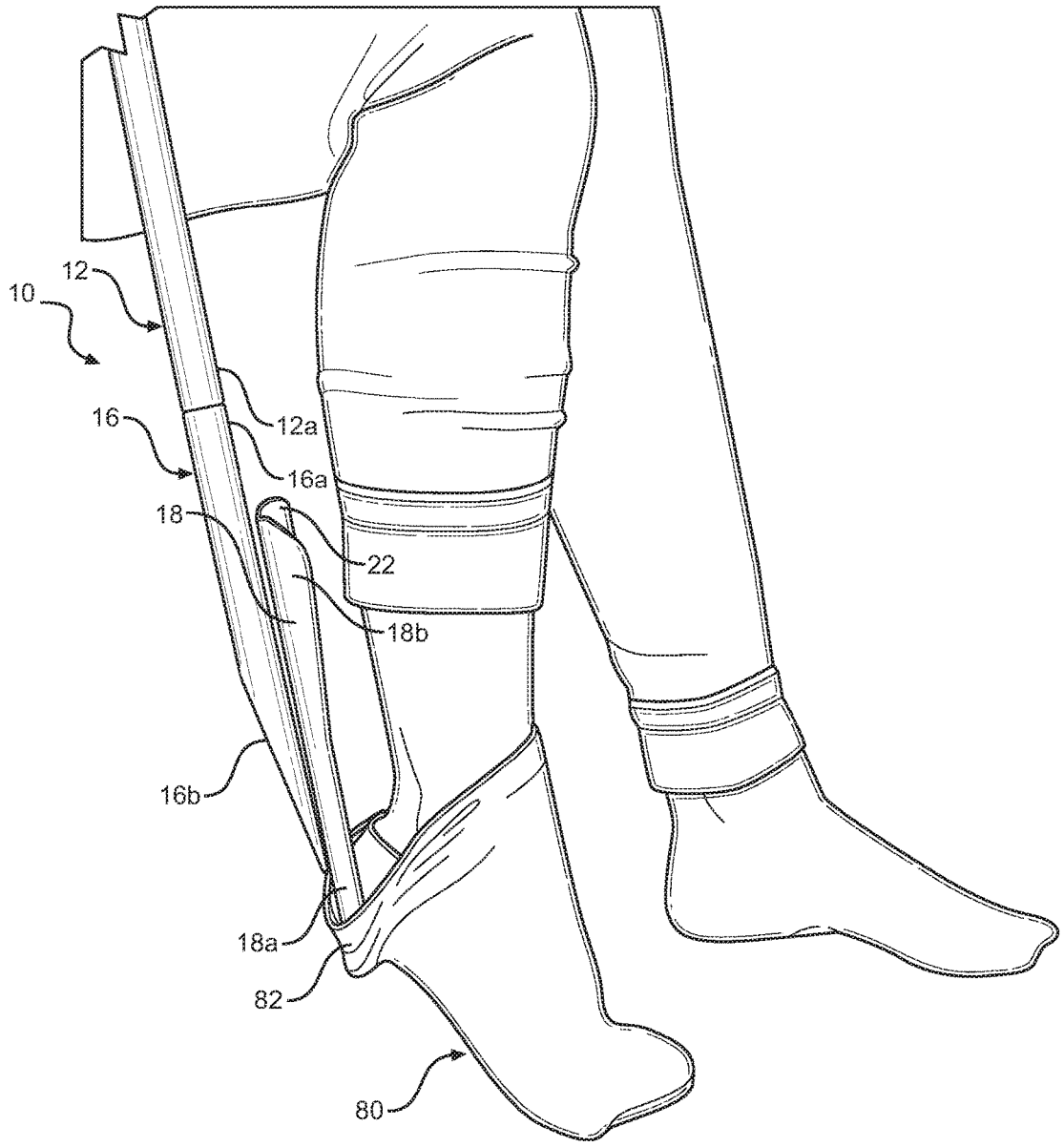
FIG. 6 shows a second exemplary use scenario, with the tool of FIG. 1 in a sock removing position.

FIG. 6 shows a second exemplary use scenario, with the tool 10 of FIG. 1 in a sock removing position. In embodiments, the tool 10 in the position of FIG. 5A may be utilized to remove a user's sock. In aspects, the user may manipulate the tool 10 such that the gripping portion 20 (depicted in FIG. 5A, for example) engages the user's sock 80. By utilizing the frictional force supplied by the gripping portion 20 engaging the user's sock 80, a user may push a top of the sock 82 down the user's leg towards the user's toes, thus aiding the user in removal of the sock 80.

Figure 7:
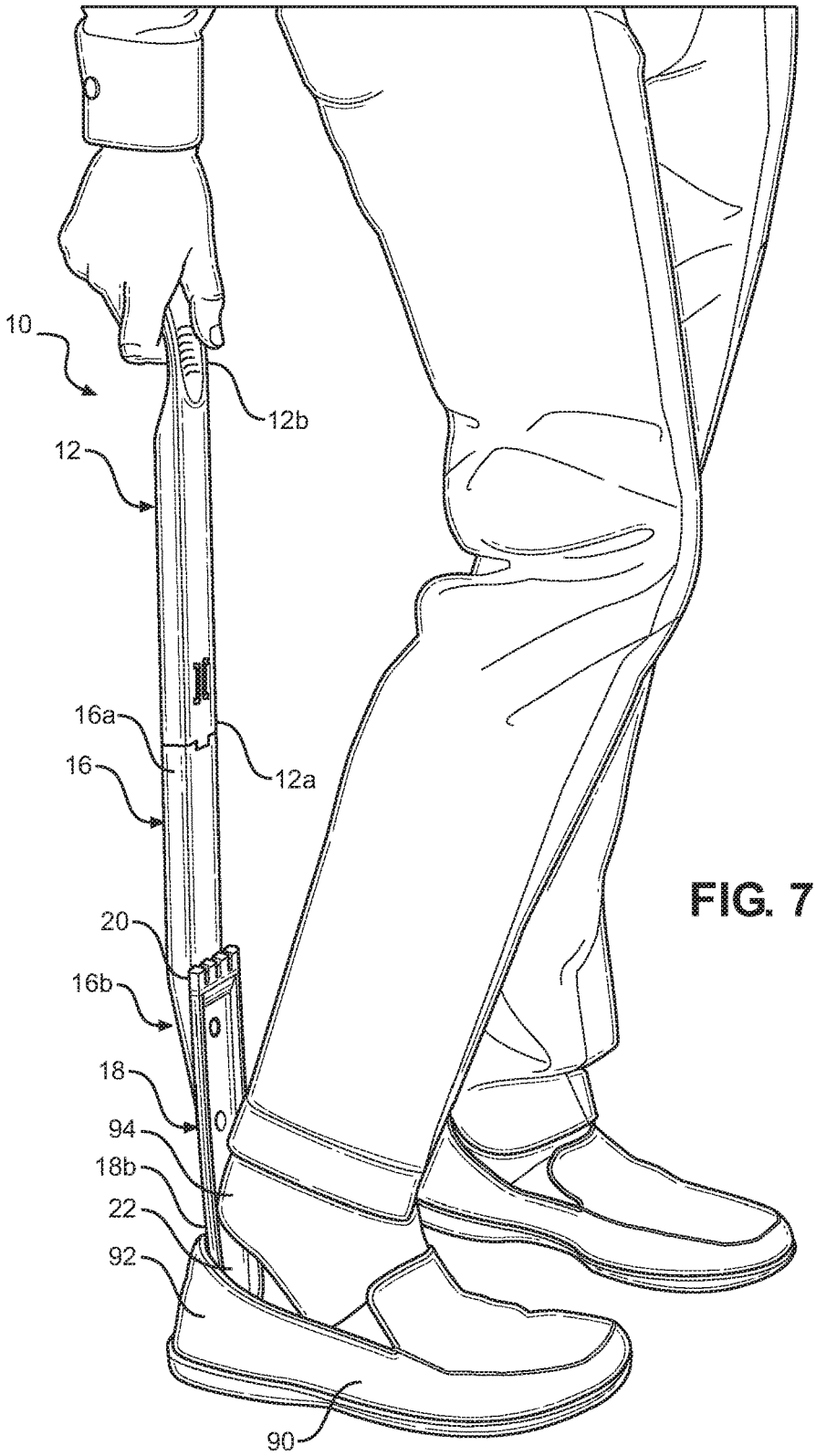
FIG. 7 shows a third exemplary use scenario, with the tool of FIG. 1 in a shoe horn position.

FIG. 7 shows a third exemplary use scenario, with the tool of FIG. 1 in a shoe horn position. In embodiments, the tool 10 in the position of FIG. 5C may be utilized to assist a user in donning a shoe 90. As depicting, the user may manipulate the tool 10 such that a back side of the curved heel-engaging portion 22 is located adjacent a heel portion 92 of the shoe 90, enabling the user to slide their heel 94 into the shoe 90.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A shoe horn and sock removing tool comprising:
a handle portion; and
a shoe horn and sock removing portion comprising:
a main body; and
a head comprising a first end including a gripping portion and a second end including a curved heel-engaging portion,
wherein the head is pivotally connected to the main body and is configured to be pivoted between a locked shoe horn position wherein the gripping portion extends past an end of the main body, and a locked sock removing position wherein the curved heel-engaging portion extends past the end of the main body.

2. The shoe horn and sock removing tool of claim 1, further comprising an engagement finger extending from the main body and adapted to pivot away from a front face of the main body, the engagement finger including an engagement button extending therefrom adapted to be received in a first receiving aperture formed in the head in the locked sock removing position and receive in a second receiving aperture formed in the head during the locked shoe horn position.

3. The shoe horn and sock removing tool of claim 1, further comprising a means for selectively locking the head to the main body in a shoe horn removing position or a sock removing position.

4. The shoe horn and sock removing tool of claim 1, wherein the gripping portion is comprised of a high friction material and the curved heel-engaging portion is comprised of a low friction material.

5. The shoe horn and sock removing tool of claim 4, wherein the gripping portion is rubber and the curved heel-engaging portion is plastic.

6. The shoe horn and sock removing tool of claim 1, wherein the handle portion comprises a first end adapted to be gripped by a user and a second end spaced from the first end, and the shoe horn and sock removing portion is removably connected to the second end of the handle portion.

7. The shoe horn and sock removing tool of claim 6, further comprising:
a retention aperture formed at a first end of the main body; and
an engagement finger extending from the second end of the handle portion and adapted to engage with the retention aperture in the main body.

8. The shoe horn and sock removing tool of claim 6, further comprising:

first and second flexible retention fingers extending from a surface of the handle portion; and first and second tab-receiving apertures formed in the main body, wherein the first and second flexible retention fingers are adapted to be received into the respective first and second tab-receiving apertures to removably lock the handle portion to the main body portion.

9. The shoe horn and sock removing tool of claim 8, wherein the handle portion is adapted to be disconnected from the main body portion by applying, simultaneously, a downward force to a back side of the handle portion at a position spaced from the first and second flexible retention fingers and a downward force to a back side of the main body at a position spaced from the first and second tab-receiving apertures, while bracing the first and second flexible retention fingers and the first and second tab-receiving apertures in stationary position.

10. A shoe horn and sock removing tool comprising:

a shoe horn and sock removing portion comprising:

a main body; and a head comprising a first end including a gripping portion comprised of a high friction material and a second end including a curved heel-engaging portion, wherein the head is pivotally connected to the main body and is configured to be pivoted between a locked shoe horn position wherein the curved heel-engaging portion is directly adjacent the main body and the gripping portion extends past an end of the main body, and a locked sock removing position wherein the gripping portion is directly adjacent the main body and the curved heel-engaging portion extends past the end of the main body;

a handle portion; and a means for removably connecting the shoe horn and sock removing portion to the handle portion.

11. The shoe horn and sock removing tool of claim 10, wherein the gripping portion is comprised of a high friction material and the curved heel-engaging portion is comprised of a low friction material.

12. The shoe horn and sock removing tool of claim 11, wherein the gripping portion is rubber and the curved heel-engaging portion is plastic.

13. A method for utilizing a shoe horn and sock removing tool comprising:

providing a shoe horn and sock removing tool including a handle portion and a shoe horn and sock removing portion, the shoe horn and sock removing portion including a main body pivotally connected to a head about a connector;

pivoting the head about the connector from a shoe horn position, wherein a gripping portion of the head extends past an end of the main body, to a sock removing position, wherein a curved heel-engaging portion of the head extends past the end of the main body.

14. The method of claim 13, further comprising pressing on a flexible tab of the main body to unlock the flexible tab from the head before pivoting the head about the connector.

* * * * *